US012036435B2

(12) United States Patent
Canole

(10) Patent No.: US 12,036,435 B2
(45) Date of Patent: Jul. 16, 2024

(54) WEARABLE EXERCISE DEVICE WITH ADJUSTABLE RESISTANCE

(71) Applicant: Neritan Canole, Southampton, PA (US)

(72) Inventor: Neritan Canole, Southampton, PA (US)

( * ) Notice: Subject to any disclaimer, the term of this patent is extended or adjusted under 35 U.S.C. 154(b) by 32 days.

(21) Appl. No.: 17/591,370

(22) Filed: Feb. 2, 2022

(65) Prior Publication Data

US 2023/0241447 A1 Aug. 3, 2023

(51) Int. Cl.

| | |
|---|---|
| ***A63B 21/00*** | (2006.01) |
| ***A63B 21/02*** | (2006.01) |
| ***A63B 21/055*** | (2006.01) |
| ***A63B 23/035*** | (2006.01) |
| ***A63B 23/12*** | (2006.01) |

(52) U.S. Cl.

CPC ..... *A63B 21/151* (2013.01); *A63B 21/023* (2013.01); *A63B 21/0552* (2013.01); *A63B 21/4009* (2015.10); *A63B 21/4025* (2015.10); *A63B 21/4035* (2015.10); *A63B 21/4043* (2015.10); *A63B 23/03541* (2013.01); *A63B 23/1209* (2013.01)

(58) Field of Classification Search

CPC ..... A63B 21/00058; A63B 21/00069; A63B 21/00072; A63B 21/00076; A63B 21/02; A63B 21/023; A63B 21/025; A63B 21/04; A63B 21/0442; A63B 21/055; A63B 21/0552; A63B 21/0555; A63B 21/0557; A63B 21/15; A63B 21/151; A63B 21/153; A63B 21/154; A63B 21/4009; A63B 21/4023; A63B 21/4025; A63B 21/4033; A63B 21/4035; A63B 21/4039; A63B 21/4043; A63B 23/035; A63B 23/03516; A63B 23/03533; A63B 23/03541; A63B 23/12; A63B 23/1209; A63B 2209/00; A63B 2225/09

See application file for complete search history.

(56) References Cited

U.S. PATENT DOCUMENTS

| | | | | |
|---|---|---|---|---|
| 4,441,707 A | | 4/1984 | Bosch | |
| 5,328,432 A | * | 7/1994 | Gvoich | A63B 21/00069 482/114 |
| 5,358,461 A | * | 10/1994 | Bailey, Jr. | A63B 21/153 290/1 R |

(Continued)

*Primary Examiner* — Gary D Urbiel Goldner

(74) *Attorney, Agent, or Firm* — Boudwin Intellectual Property Law, LLC; Daniel Boudwin

(57) ABSTRACT

A wearable exercise device with adjustable resistance adjustment controls includes a strap having a first fastener on a first end and a second mating fastener on a second end, wherein the strap is configured to removably secure around a user's waist. A housing connected to the strap, which includes a pair of internal spools each operably connected to a spring-loaded resistance mechanism. A cable is affixed at one end to each internal spool. The cables extend outwardly from opposing sides of the housing through a pair of cable openings. A handle is connected to an opposing end of each cable. A pair of resistance adjustment controls disposed on the housing are operably connected to each spring-loaded resistance mechanism. The user can wear the waist strap and grasp the handles to perform arm exercises. The resistance adjustment controls allow the user to independently adjust the resistance of each cable.

9 Claims, 4 Drawing Sheets

(56) References Cited

U.S. PATENT DOCUMENTS

| | | | | | |
|---|---|---|---|---|---|
| 5,509,873 | A * | 4/1996 | Corn | A63B 21/4043 | 482/127 |
| 5,618,249 | A * | 4/1997 | Marshall | A63B 21/4001 | 482/92 |
| 5,733,231 | A * | 3/1998 | Corn | A63B 21/153 | 482/127 |
| 5,795,274 | A * | 8/1998 | Kasbohm | A63B 21/00069 | 482/126 |
| D399,272 | S * | 10/1998 | Zwonitzer | A63B 21/4035 | D21/683 |
| 5,876,310 | A | 3/1999 | Mackey et al. | | |
| 6,099,447 | A * | 8/2000 | Ramsaroop | A63B 21/153 | 482/127 |
| 6,120,422 | A * | 9/2000 | Kiemer | A63B 21/4035 | 482/114 |
| 9,320,936 | B1 * | 4/2016 | Rea | A63B 23/1209 | |
| 2003/0054924 | A1 * | 3/2003 | Amore | A63B 21/4025 | 482/92 |
| 2004/0053755 | A1 | 3/2004 | Wilkinson | | |
| 2005/0227833 | A1 | 10/2005 | Wilkinson | | |
| 2008/0026922 | A1 * | 1/2008 | Smith | A63B 21/4001 | 482/124 |
| 2013/0303347 | A1 | 11/2013 | Malmqvist | | |
| 2020/0121968 | A1 * | 4/2020 | Ismail | A63B 21/1681 | |
| 2021/0339077 | A1 * | 11/2021 | Larson | A63B 21/4009 | |

* cited by examiner

WEARABLE EXERCISE DEVICE WITH ADJUSTABLE RESISTANCE

BACKGROUND OF THE INVENTION

The present invention relates to a wearable exercise device. More specifically, the present invention provides a wearable exercise device that can be worn around the waist of the user, which includes a pair of cables each having independently adjustable resistance.

It is important for individuals to exercise to maintain their overall physical fitness and health. Resistance-based exercises can help to build and maintain muscle mass throughout the body. Some individuals use free weights to apply resistance while exercising. One drawback to this is that individuals must have multiple dumbbells or the like that have different weights. It can be expensive to obtain the different weights and difficult to transport them. Another option is to utilize elastic resistance bands. However, the same problem occurs where individuals must have multiple resistance bands if they want to have different options for the resistance being applied during exercise. Further, such bands are difficult to transport and cannot easily be utilized while the individual is in motion. Due to time constraints, some individuals forgo cardio exercises to do resistance-based exercises, and vice versa, while it is important to focus on all aspects of fitness. In order to address these concerns, the present invention provides a wearable exercise device that can be utilized in any position or location, while the user is sitting or standing, and can further be adjusted for providing different levels of resistance with the same device.

Some devices have been disclosed in the known art that relate to wearable exercise devices. These include devices that have been patented and devices that have been disclosed in published patent applications. However, the devices in the known art include several drawbacks. For example, the wearable devices in the known art typically only include a single resistance level. For those that are adjustable, it is not possible to adjust the resistance of multiple cables or similar devices to different levels. The lack of individual adjustment limits the overall useability of the devices in the known art. In light of the devices disclosed in the known art, it is submitted that the present invention substantially diverges in structural and functional elements from the known art. It is clear that there is a need in the art for an improvement to wearable exercise devices, particularly with regard to the above-described need for a wearable exercise device that has independently adjustable resistance cancels. In this regard the present invention substantially fulfills these needs.

SUMMARY OF THE INVENTION

The present invention provides a wearable exercise device with adjustable resistance cables wherein the same can be utilized for exercising while seated, standing, walking, or while not moving, in a way that allows the user to adjust the resistance of each individual cable. In general, wearable exercise device with adjustable resistance includes a strap having a first fastener on a first end and a second mating fastener on a second end, wherein the strap is configured to removably secure around a user's waist. A housing connected to the strap, which includes a pair of internal spools each operably connected to a spring-loaded resistance mechanism. A cable is affixed at one end to each internal spool. The cables extend outwardly from opposing sides of the housing through a pair of cable openings. A handle is connected to an opposing end of each cable. A pair of resistance adjustment controls disposed on the housing are operably connected to each spring-loaded resistance mechanism. The user can wear the waist strap and grasp the handles to perform arm exercises. The resistance adjustment controls allow the user to independently adjust the resistance of each cable.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
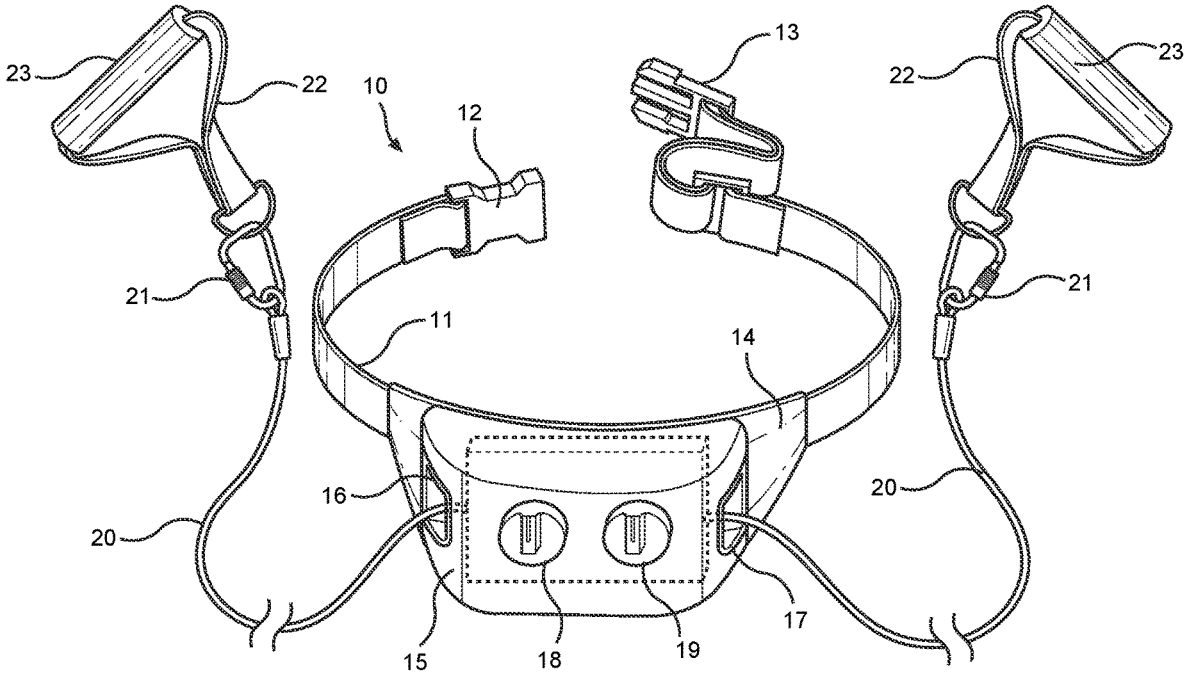
FIG. 1 shows a perspective view of an embodiment of the wearable exercise device with adjustable resistance.

Reference is made herein to the attached drawings. Like reference numerals are used throughout the drawings to depict like or similar elements of the wearable exercise device with adjustable resistance. For the purposes of presenting a brief and clear description of the present invention, a preferred embodiment will be discussed as used for exercising in any desired position with multiple cables that can be independently adjusted for a completely customizable workout.

Referring now to FIG. 1, there is shown a perspective view of an embodiment of the wearable exercise device with adjustable resistance. The device 10 generally includes a strap 11 that is configured to removably secure around the user's waist. The strap 11 can have a fixed length or be adjustable in length via a slide adjuster or any other suitable adjustment mechanism. In the shown embodiment, the strap 11 includes a slide buckle 13 on a first end and a slide buckle receiver 12 on an opposing second end. In other embodiments, other types of fasteners may be utilized, including but not limited to hook and loop material, snaps, clips, and the like.

A housing 15 is connected to the strap 11, which includes the internal resistance and cable attachment components of the device 10. In the shown embodiment, the housing 15 is connected to the strap 11 via a fixed fabric connection 14 between the strap 11 and housing 15 on opposing ends of the housing 15. In other embodiments, the housing 15 may be adjustably secured to the strap 11, such that the user can adjust the position of the housing 15 along a length of the strap 11. The housing 15 houses a pair of internal spools each operably connected to a spring-loaded resistance mechanism. A cable 20 is affixed at one end to each internal spool. Each cable and extends outwardly from opposing sides of the housing through a pair of cable openings 16, 17.

The perimeters of the cable openings 16, 17 may be rigid in order to prevent them from collapsing around the cables 20.

A handle 23 is connected to an opposing end of each cable 20. In the shown embodiment, each handle 23 includes a grip rotatably coupled to a handle strap 22. The rotatable grip allows for enhanced range of motion when gripping the handle 23. A handle ring is connected to the handle strap 22, which is utilized to secure the handle 23 to a handle connector 21 that is removably secured to the free end of each cable 20. The handle connector 21 is configured to removably secure the handle ring to each cable 20. In this way, the user can attach handles having different configurations for comfort or for different types of exercises if desired. A pair of resistance adjustment controls 18, 19 disposed on the housing allow the user to adjust the resistance of each cable 20. Each resistance adjustment control 18, 19 is operably connected, and configured to adjust the resistance of, each spring-loaded resistance mechanism.

Figure 2:
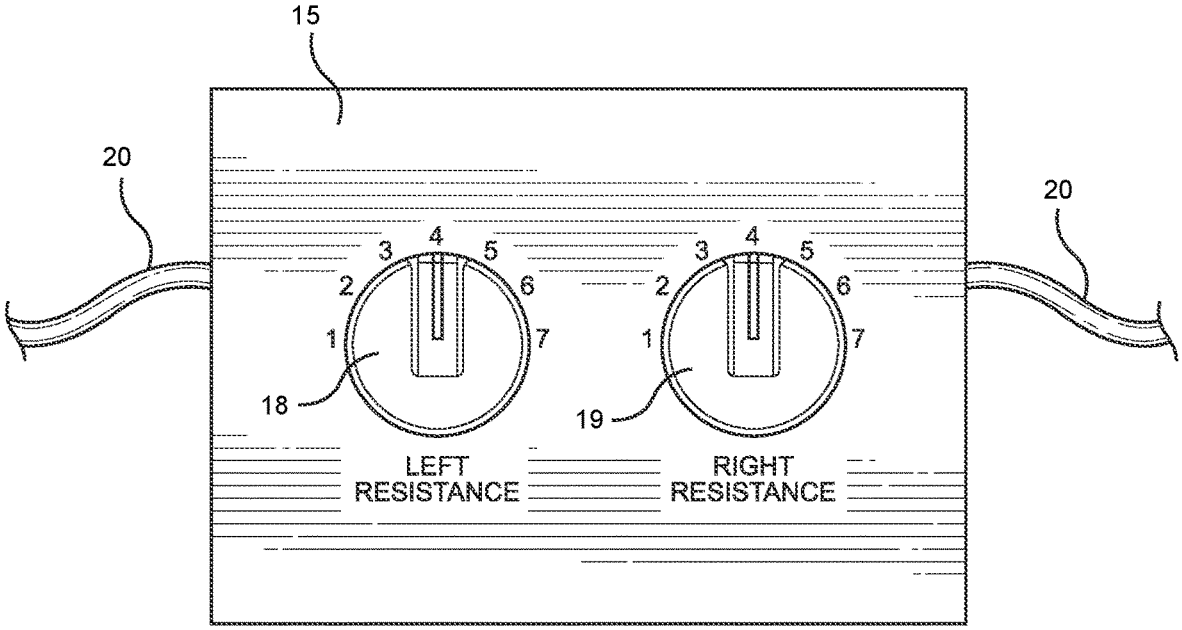
FIG. 2 shows a front elevation view of the housing component from an embodiment of the wearable exercise device with adjustable resistance.

Referring now to FIG. 2, there is shown a front elevation view of the housing component from an embodiment of the wearable exercise device with adjustable resistance. In the shown embodiment, each resistance adjustment control 18, 19 comprises a rotatable dial disposed on a front facing side of the housing. There may be indicia disposed around the dials which indicate to the user the currently selected level of resistance. The indicia can indicate specific weights, or can be numerical increments that represent the different levels of resistance. Independent dials allows the user to adjust the resistance of each cable independently, offering greater customization.

Figure 3:
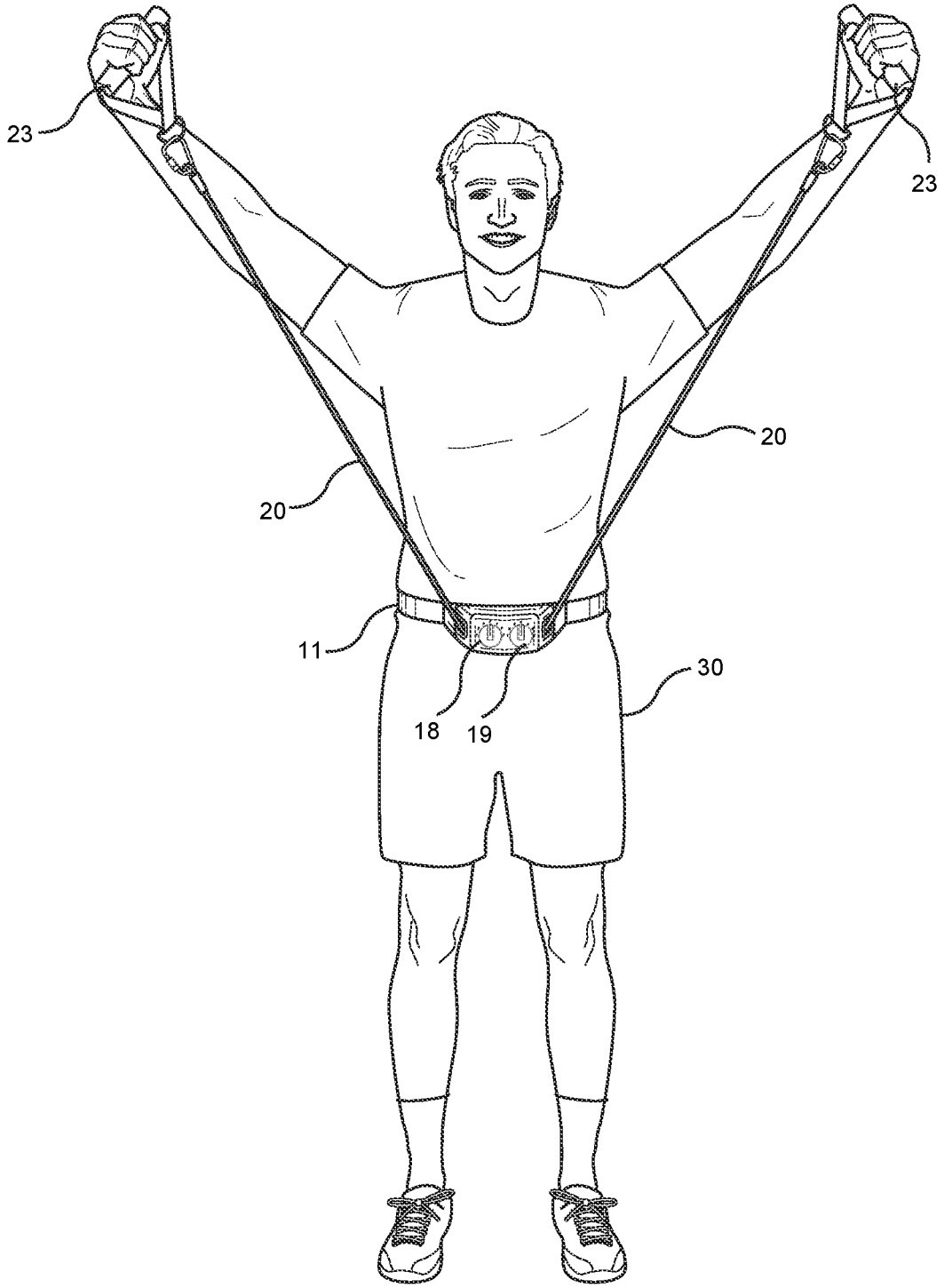
FIG. 3 shows a perspective view of an embodiment of the wearable exercise device with adjustable resistance in use.

Referring now to FIG. 3, there is shown a perspective view of an embodiment of the wearable exercise device with adjustable resistance in use. In operation, the user 30 can secure the strap 11 around their waist. The user 30 can then set the resistance adjustment controls 18, 19 to a desired resistance, grasp the handles 23, and press or pull the cables 20 outwardly from the housing. Each spring-loaded resistance mechanism is configured to bias its attached cable 20 to a retracted position, thereby applying a resistance to each cable 20. The cables 20 may be elastic or inelastic according to user preference. While the user 30 is shown in a standing position, the present invention can be utilized in any suitable position. For example, the user may perform exercises while wearing the strap 11 in a seated position. The user may also walk, jog, or run while wearing the device, allowing them to perform resistance exercises with the hands and arms while also performing aerobic exercises.

Figure 4:
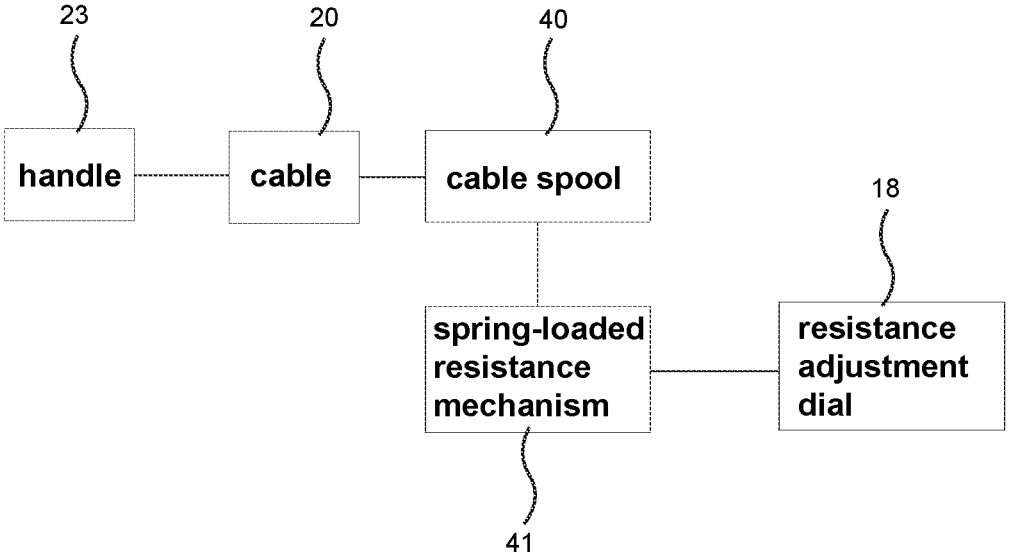
FIG. 4 shows a block diagram of the components from an embodiment of the wearable exercise device with adjustable resistance.

Referring now to FIG. 4, there is shown a block diagram of the components from an embodiment of the wearable exercise device with adjustable resistance. The handle 23 and cable 20 are affixed to the cable spool 40 that is positioned within the housing. The cable spool 40 can include an integral spring-loaded resistance mechanism, such as a spring-rewind mechanism, for example. The cable spool 40 can also be mechanically coupled to a separated spring-loaded resistance mechanism. The resistance adjustment dial 18 is operably connected to one of the spring loaded resistance mechanisms 41. Rotating the resistance adjustment dial 18 in one direction reduces resistance as the cable 20 is pulled out of the housing, while rotating the resistance adjustment dial 18 in an opposite direction increases resistance as the cable 20 is pulled out of the housing. The user can thus independently adjust the resistance of each cable 20, allowing not only for different resistance values in a single device, but also different adjustments for each arm. In this way, the user can customize the resistance applied to each arm without the need to remove the device from its waist attachment.

It is therefore submitted that the present invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, and all equivalent relationships to those illustrated in the drawings and described in the specification are intended to be encompassed by the present invention.

The foregoing is considered as illustrative only of the principles of the invention. Further, it is not desired to limit the invention to the exact construction and operation shown and described, and accordingly, all suitable modifications and equivalents may be resorted to, falling within the scope of the invention.

I claim:

1. A wearable exercise device, comprising:

a strap having a first fastener on a first end and a second mating fastener on a second end;

wherein the strap is configured to removably secure around a user's waist of a user;

a housing connected to the strap, the housing comprising a pair of internal spools each operably connected to a spring-loaded resistance mechanism;

a pair of cables respectively affixed at one end of each of the pair of internal spools and extending outwardly from opposing sides of the housing through a pair of cable openings;

a handle connected to an opposing end of each of the cables; and a pair of resistance adjustment controls disposed on the housing, each of the pair of resistance adjustment controls are operably connected and configured to adjust a resistance of each of the spring-loaded resistance mechanisms;

wherein the handle comprises a grip rotatably coupled to a handle strap;

further comprising a handle ring attached to the handle strap;

further comprising a handle connector removably secured to a free end of each of the cables;

wherein the housing is connected to the strap via a fixed fabric connection on opposing sides of the housing;

wherein the strap is adjustable in length; and wherein the housing is adjustably secured to the strap, such that the user adjusts a position of the housing along the length of the strap.

2. The wearable exercise device of claim 1, wherein each of the pair of spring-loaded resistance mechanisms is biased to the respectively attached cable in a retracted position.

3. The wearable exercise device of claim 1, wherein each of the pair of resistance adjustment controls comprises a rotatable dial disposed on a front facing side of the housing.

4. The wearable exercise device of claim 3, further comprising an indicia surrounding each of the pair of rotatable dials that indicates a current level of resistance for each of the cables.

5. The wearable exercise device of claim 1, wherein the first fastener of the strap comprises a slide buckle.

6. The wearable exercise device of claim 1, wherein each of the cables is elastic.

7. The wearable exercise device of claim 1, wherein each of the cables is inelastic.

8. The wearable exercise device of claim 1, wherein the handle connector to removably secures the handle ring to each of the cables.

9. The wearable exercise device of claim 1, wherein the second mating fastener on the second end of the strap comprises a slide buckle receiver.

* * * * *